US008152409B1

(12) United States Patent
Ligman

(10) Patent No.: US 8,152,409 B1
(45) Date of Patent: Apr. 10, 2012

(54) APPARATUS FOR SCREEDING CONCRETE

(76) Inventor: Peter A. Ligman, Clinton, WI (US)

( * ) Notice: Subject to any disclaimer, the term of this patent is extended or adjusted under 35 U.S.C. 154(b) by 357 days.

(21) Appl. No.: 12/139,854

(22) Filed: Jun. 16, 2008

(51) Int. Cl.
*E01C 19/22* (2006.01)

(52) U.S. Cl. ..... 404/118

(58) Field of Classification Search ..... 404/114, 404/118; 212/348, 350, 302–304; 52/118; 414/352, 400
See application file for complete search history.

(56) References Cited

U.S. PATENT DOCUMENTS

| | | | | |
|---|---|---|---|---|
| 3,341,029 | A * | 9/1967 | Barkley et al. | 212/350 |
| 3,675,721 | A * | 7/1972 | Davidson et al. | 169/24 |
| 3,721,054 | A * | 3/1973 | Hornagold | 52/115 |
| 4,036,372 | A * | 7/1977 | Rao et al. | 212/230 |
| 4,406,375 | A * | 9/1983 | Hockensmith | 212/349 |
| 4,655,633 | A | 4/1987 | Somero et al. | |
| 4,700,786 | A * | 10/1987 | Berry | 172/799.5 |
| 4,770,304 | A * | 9/1988 | Woods | 212/348 |
| 4,896,995 | A | 1/1990 | Simmons | |
| 4,930,935 | A | 6/1990 | Quenzie et al. | |
| 5,039,249 | A | 8/1991 | Hansen et al. | |
| 5,217,320 | A * | 6/1993 | Cioffi | 404/133.2 |
| 5,234,281 | A | 8/1993 | Somero et al. | |
| 5,515,654 | A * | 5/1996 | Anderson | 52/118 |
| 6,129,481 | A | 10/2000 | Tapio et al. | |
| 6,328,115 | B1 * | 12/2001 | Carter, Jr. | 172/799.5 |
| 6,530,721 | B2 | 3/2003 | Yost | |
| 6,695,532 | B2 | 2/2004 | Somero et al. | |
| 6,729,796 | B1 | 5/2004 | Green | |
| 6,860,676 | B2 * | 3/2005 | Pont Feixes | 404/118 |
| 7,044,681 | B2 | 5/2006 | Quenzie et al. | |
| 7,121,762 | B2 | 10/2006 | Quenzie et al. | |
| 7,144,191 | B2 | 12/2006 | Kieranen et al. | |
| 7,175,363 | B2 | 2/2007 | Quenzie et al. | |
| 7,195,423 | B2 | 3/2007 | Halonen et al. | |
| 7,232,277 | B2 | 6/2007 | Corbitt | |
| 7,497,140 | B2 * | 3/2009 | Blackwelder et al. | 74/89.28 |
| 2004/0154237 | A1 * | 8/2004 | Mainville | 52/118 |
| 2006/0216114 | A1 | 9/2006 | Quenzie et al. | |
| 2007/0031191 | A1 | 2/2007 | Quenzie et al. | |
| 2007/0116520 | A1 * | 5/2007 | Quenzi et al. | 404/114 |
| 2007/0127985 | A1 | 6/2007 | Halonen et al. | |
| 2007/0140792 | A1 | 6/2007 | Quenzie et al. | |

* cited by examiner

*Primary Examiner* — Thomas Will
*Assistant Examiner* — Abigail A Risic
(74) *Attorney, Agent, or Firm* — Alexander P. Brackett; Middleton Reutlinger

(57) ABSTRACT

An apparatus for screeding concrete to produce a level finished surface includes a rigid frame assembly; a telescopic boom assembly secured directly to the frame assembly; and a screeder head assembly having a plurality of vertically oriented alignment poles secured to the boom assembly. The telescopic boom assembly may include a plurality of boom sections, each having a leveling mechanism whereby each boom section may be individually leveled with respect to each preceding boom section to provide for a consistently level finished surface.

11 Claims, 14 Drawing Sheets

APPARATUS FOR SCREEDING CONCRETE

BACKGROUND OF THE INVENTION

1. Field of the Invention

The present invention relates generally to a method and apparatus for troweling or screeding concrete and more specifically to an apparatus for screeding a poured concrete surface having a rigid frame structure and a telescopic boom that is secured directly thereto, said telescopic boom constructed to include a leveling system to maintain each section of the boom level with each preceding section thereof eliminating the need for continuous leveling controls, thereby providing a superior level finished surface.

2. Description of the Related Art

In the construction industry when liquid concrete is poured to produce a finished level surface it must be carefully leveled and smoothed, or screeded, so that when the concrete sets it produces an even, level surface. Since this level surface is almost always a foundation for additional construction, machine base applications, or for vertical storage such as warehousing space, it is highly desirable to produce a surface that is consistently level over its entire area. In large poured areas it is unwieldy and labor intensive to manually level and smooth a poured surface as well as extremely difficult to maintain a consistent finished grade.

In order to aid in the screeding of large surface area concrete pours, a variety of screeding or troweling machines have been accepted into use in the art. These machines typically include a screed head comprising a flat troweling surface for contacting the poured concrete mounted on a boom that is mechanically extended and retracted across the concrete surface to produce a smooth finish thereon. Many of these prior art devices include various systems for leveling the screed head relative to a reference plane such that the finished surface is relatively flat once it is screeded.

The leveling systems in prior art devices may encompass laser eyes mounted on the screed head structure that detect a laser beam projected at a predetermined level reference height above grade. Thus the screed head may be adjusted to a predetermined grade level by aligning said laser eyes with a projected laser beam. Furthermore, many of these devices provide automated means for adjusting the screed head upwardly or downwardly to a level reference plane, thus obviating the need for manual alignment. In some systems, the automated adjustment of the screed head requires the use of multiple sensors and actuators along with the concomitant wiring and computerized control systems required to effect the necessary leveling adjustments.

Prior art screeding devices often comprise a frame having a centrally mounted turret from which a boom is extended. One such system is disclosed in U.S. Pat. No. 5,039,249 to Hansen et al. Turret type screeders provide for some maneuverability since the turrets are capable of rotation via a driven gear or similar mechanism. These screeding systems are typically quite complex and costly due to the need for complicated mechanical and electrical controls not to mention the power required to position a turret. In fact, while many prior art screeding devices are available, a great deal of concrete screeding is still accomplished by hand due to the size and cost of automated screeders.

Additionally, turret-type systems, while providing for consistently level finished surfaces are extremely complex in terms of mechanical construction and control systems required for operation since they necessarily have a boom that extends from a central point of attachment to the screeder. In order to withstand the rigors of continuous use in construction environments, booms are typically comprised of a metal alloy which makes them quite heavy. As a result, when the boom is fully extended outwardly from the turret, there is some variation in the level of the screed head since a great deal of weight is secured to a single point of the screeding apparatus, namely the turret.

Another disadvantage in prior art screeding systems is the inability to level the boom relative to the screed head and the frame or body of the system. In many prior art devices, a plurality of legs or outriggers are provided to level the frame of the apparatus, and then the screed head is set to an appropriate finish grade height using the laser leveling process previously discussed. These systems typically approximate leveling the boom with respect to the frame in order to bring the screed head within a predetermined level tolerance for operational purposes. However, there remains a great deal of play or "slop" in the leveling process due to the size and weight of the boom and it's attachment to the screeder frame.

Accordingly, there is a need in the art for a system and method screeding and troweling concrete that provides a consistently level finished surface with a minimum of mechanical and electrical system complexity.

SUMMARY OF THE INVENTION

The present invention overcomes the aforementioned difficulties in the prior art by providing a concrete screeding apparatus, known in the art as a screeder, having a rigid frame assembly and a telescopic boom assembly secured directly thereto. The invention also includes a conventional internal combustion engine having an output shaft coupled to an hydraulic pump, for supplying pressurized hydraulic fluid to a plurality of components necessary to operate the screeder via a plurality of electrically actuated control valves.

In one embodiment, the invention further comprises a telescopic boom assembly having an exterior, intermediate and interior boom, wherein the intermediate and interior booms may be extended and retracted by means of a single hydraulic cylinder. The exterior boom is secured directly to the frame assembly. Additionally, the boom assembly comprises a plurality of front and rear leveling plates which permits extremely accurate leveling of the interior and intermediate booms with respect to the exterior boom, and thus with respect to the frame of the screeding apparatus. This feature of the invention provides for an extremely level finished concrete surface at a fraction of the cost of more complex screeding systems.

Other features, objects and advantages of the present invention will become apparent from the detailed description of the drawing Figures taken in conjunction with the appended drawing Figures.

BRIEF DESCRIPTION OF THE DRAWING FIGURES

DETAILED DESCRIPTION OF THE PREFERRED EMBODIMENT(S)

Figure 1:
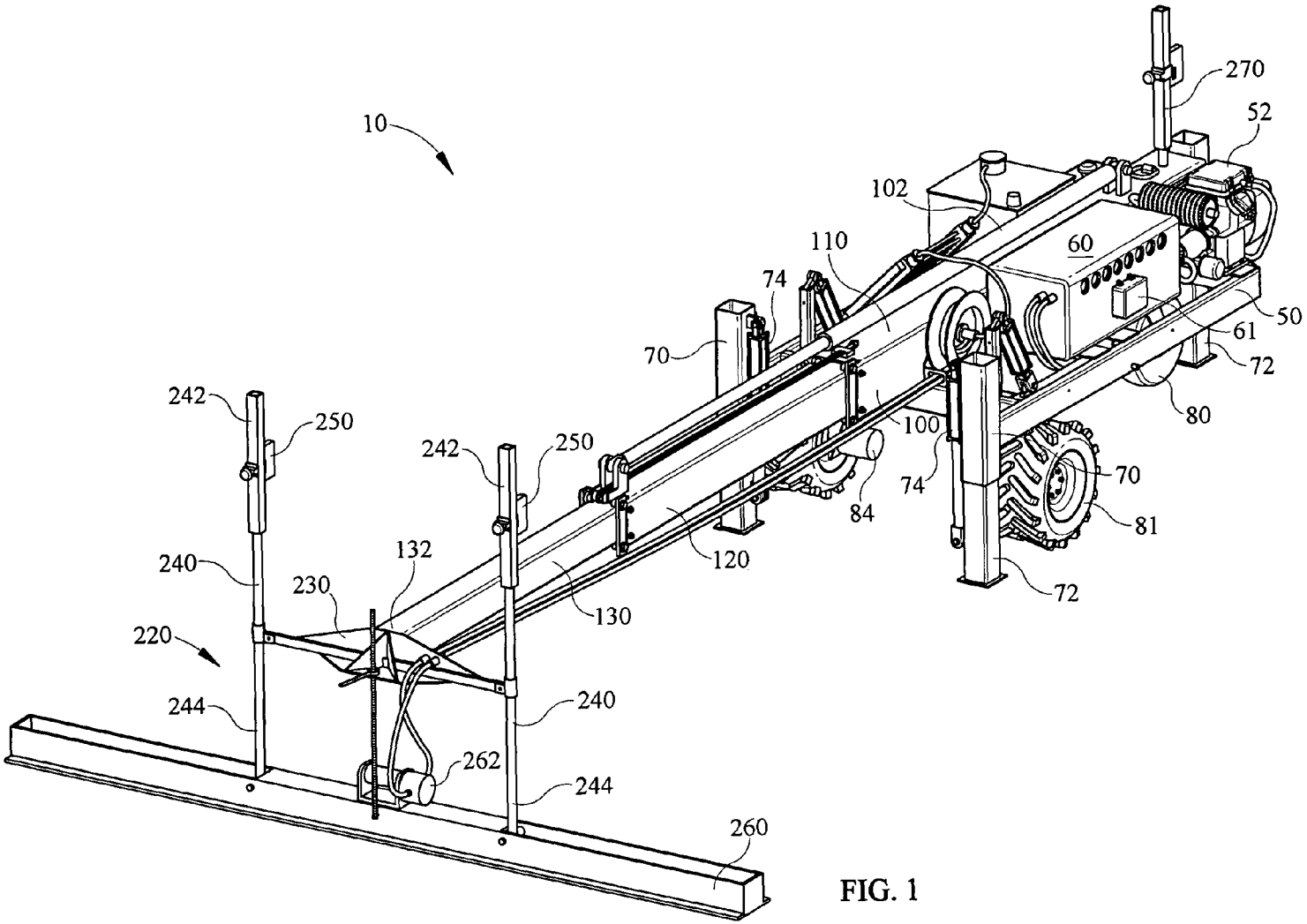
FIG. 1 is a perspective view of a concrete screeder in accordance with one embodiment of the present invention.
Figure 2:
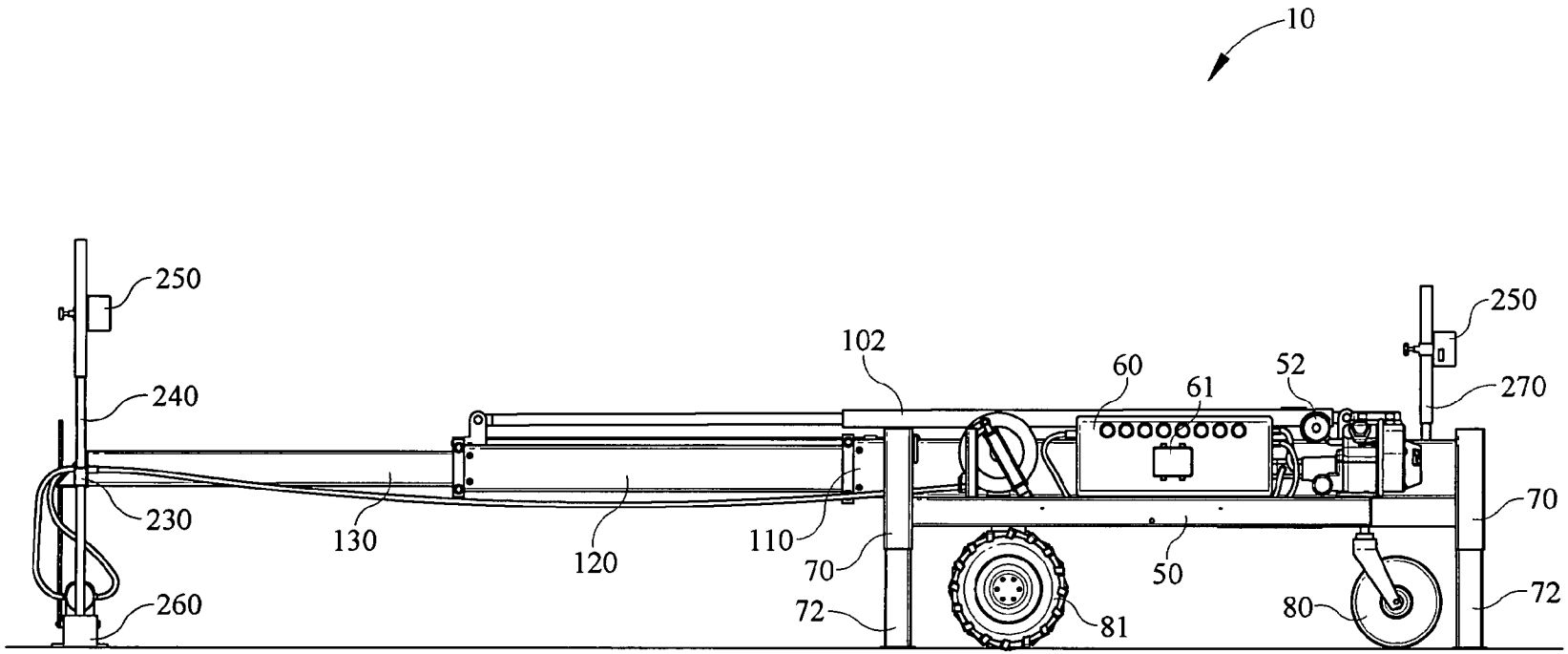
FIG. 2 is an elevation view of a concrete screeder with its boom extended in accordance with one embodiment of the present invention.

Referring now to FIGS. 1-4 and in accordance with one embodiment of the present invention, a concrete screeding apparatus 10 comprises a rigid frame assembly 50 on which a conventional internal combustion engine 52 is mounted. Engine 52 supplies power via a conventional output shaft to an hydraulic assembly 60, also mounted on frame assembly 50. Hydraulic assembly 60 may typically include a pump for pressurizing hydraulic fluid and a plurality of electrically actuated control values (not shown) for supplying pressurized hydraulic fluid to a plurality of components as discussed in detail below. Hydraulic assembly 60 may further comprise a control system (not shown) which may include a microprocessor, data memory, inputs and outputs, a wireless transceiver 61, and requisite wiring to electrically connect the control system to the plurality of valves. Throughout the specification the operation of hydraulic cylinders will be understood to be effected through the use of a conventional hydraulic valve and control system, as is well-known to one of ordinary skill in the art.

A plurality of adjustable stabilization legs 70 are secured in a generally vertical orientation to frame assembly 50 at a plurality of points around the perimeter thereof. As shown in the drawing Figures, in one exemplary embodiment of the invention two opposed legs 70 are secured to frame assembly 50 at a forward end thereof while a single leg 70 is secured to a rear end of frame assembly 50. One of ordinary skill in the art will understand that the number and positioning of legs 70 around frame assembly 50 may be varied without departing from the scope of the present invention.

Figure 9:
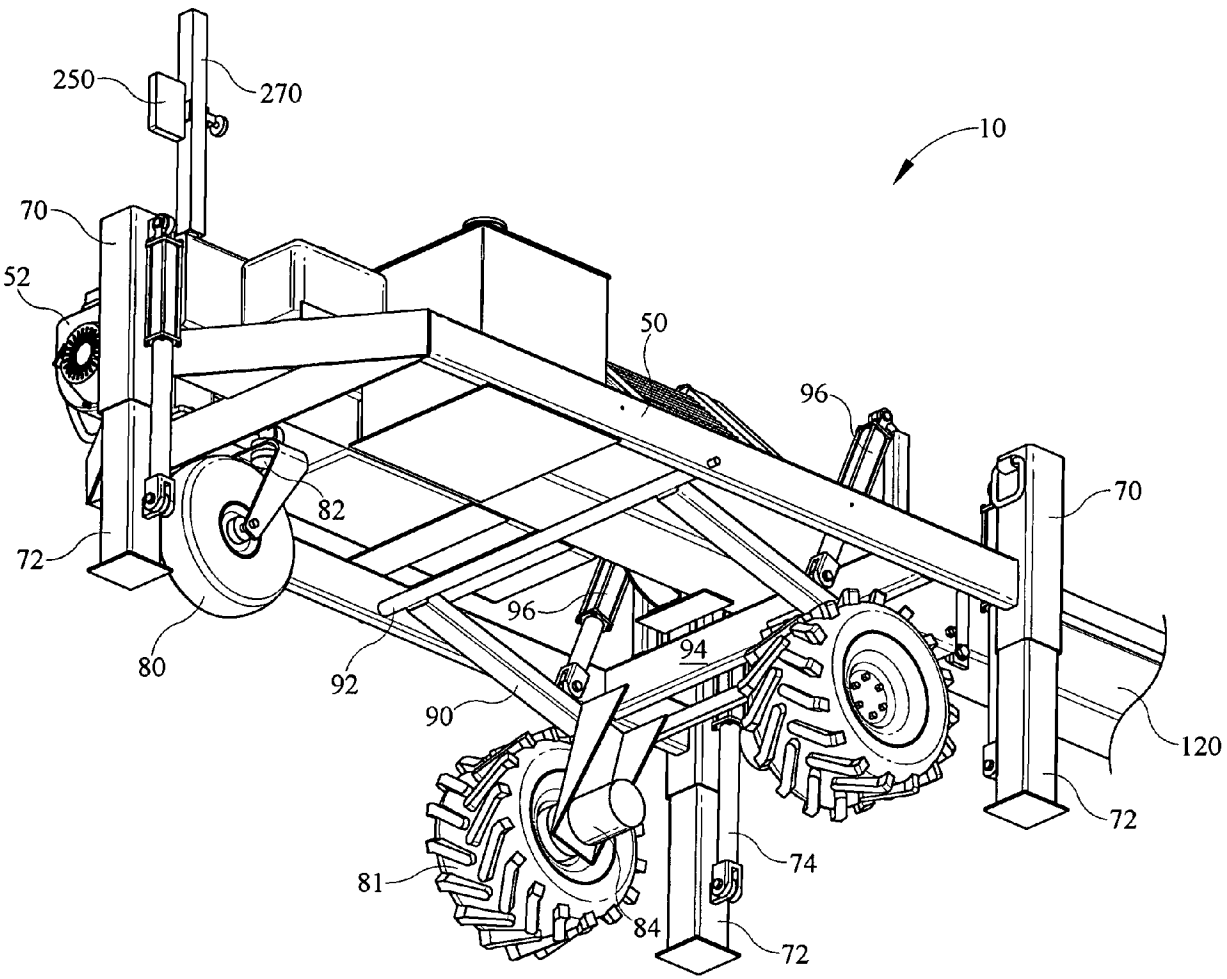
FIG. 9 is a bottom perspective view of a concrete screeder in accordance with one embodiment of the present invention.

As best viewed in FIGS. 1 and 9 each stabilization leg 70 includes a telescoping portion 72 that is secured to an hydraulic cylinder 74 that may be actuated to extend or retract telescoping position 72, thereby raising or lowering frame assembly 50. Thus by independently controlling hydraulic cylinders 74, frame assembly 50 may be raised or lowered as required to level screeding apparatus 10 to a predetermined horizontal plane suitable for the level of the grade or slope on which apparatus 10 is situated.

FIGS. 1 and 9 also depict a plurality of wheels secured to frame assembly 50 for maneuvering screeder 10. A rear wheel 80 is mounted on a pivot 82 at a central point at the rear of frame assembly 50 such that it is free to rotate in any direction as required by operation of front wheels 81, each of which is driven by an hydraulic motor 84 capable of driving wheels 81 either forwardly or backwardly. Hydraulic motor 84 is also controlled by operation of an electrically actuated valve. By driving one front wheel 81 in a forward direction and another in a reverse direction screeder 80 is readily pivoted in any direction in a minimum of space since rear wheel 80 simply follows the motion imparted to frame assembly 50 by the operation of front wheels 81.

Figure 5:
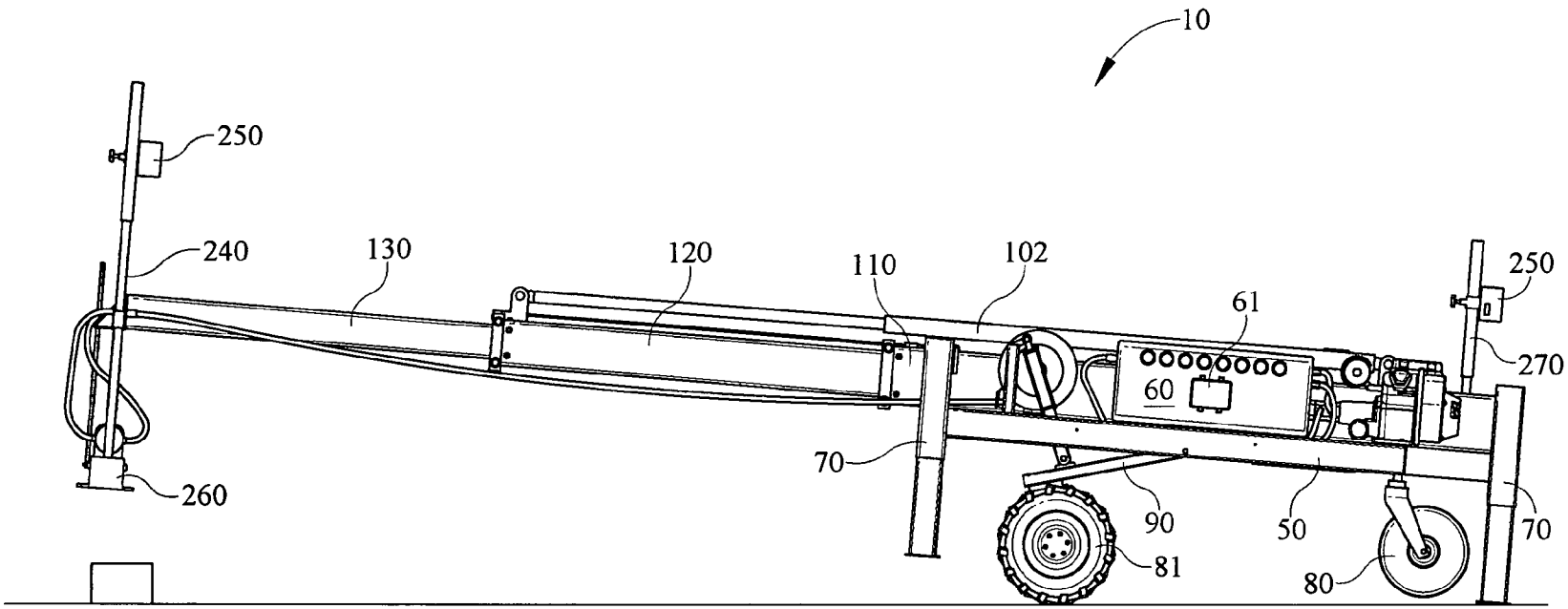
FIG. 5 is an elevation view of an elevated concrete screeder in accordance with one embodiment of the present invention.

Front wheels 81 are secured to a cantilever frame 90 that pivots around a rotatable shaft 92 secured to frame 50. Front wheels 81 are secured to a forward frame member 94, which in turn is raised and lowered by a pair of hydraulic cylinders 96 secured between frame assembly 50 and cantilever frame 90. Operation of hydraulic cylinders 96 permits the entire front end of screeder 10 to be quickly elevated, which is of practical import when avoiding obstacles in a poured surface as shown in FIG. 5.

Referring again to FIGS. 1-4 and in accordance with a constructed embodiment of the invention, screeder 10 further comprises a telescopic boom assembly 100 extending longitudinally along frame assembly 50 and secured directly thereto. Boom assembly 100, in one embodiment of the invention, comprises a three-piece telescopic assembly 100 having an exterior boom 110, an intermediate boom 120 sized to fit inside exterior boom 110 and an interior boom 130 sized to fit inside intermediate boom 120. In one embodiment of the invention, each boom 110, 120, and 130 is box-shaped in construction, having open forward and rear ends. Exterior boom 110 is secured directly to frame assembly 50 such that when frame assembly 50 is oriented via operation of legs 70 to be level, exterior boom 110 is also level.

Figure 12:
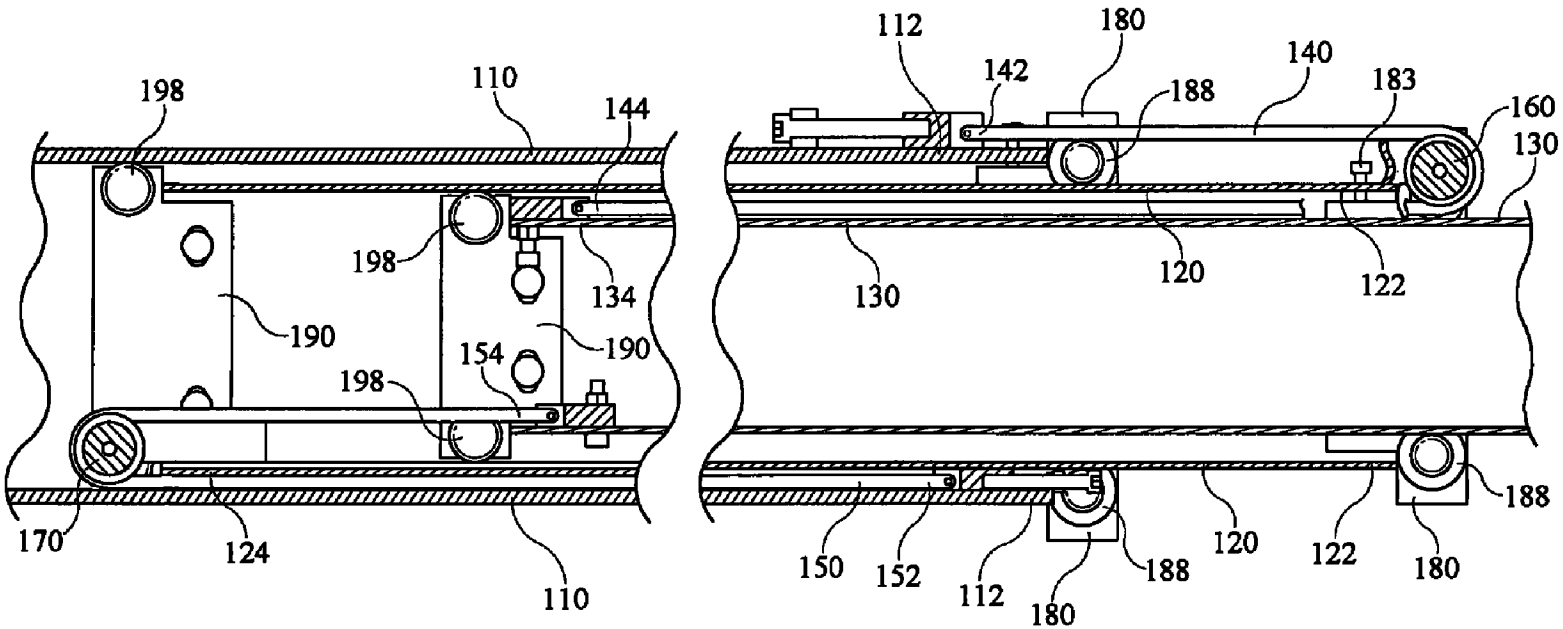
FIG. 12 is a partial cross-sectional view of a telescopic boom assembly taken along the line 12-12 of FIG. 4 in accordance with one embodiment of the present invention.

As seen in FIGS. 1-6 a single hydraulic cylinder 102 is secured at one end to exterior boom 110 and at its other end to intermediate boom 120 proximate a forward end 122 thereof. As best seen in FIG. 12, which is a partial cross-sectional view of telescopic boom assembly 100, an exterior chain 140 is secured at a first end 142 to a point proximate the forward end 112 of exterior boom 110 and routed around an exterior roller bearing 160 which is fixed to the exterior of intermediate boom 120 at the forward end 122 thereof. Exterior chain 140 is then routed inside intermediate boom 120, between the interior surface thereof and an exterior surface of interior boom 130, whereupon its second end 144 is secured to a rear end 134 thereof.

In a similar fashion an interior chain 150 is secured at a first end 152 to the interior of exterior boom 110 at a forward end 112, and routed around an interior roller bearing 170 fixed on a rear end 124 of intermediate boom 120. A second end 154 of interior chain 150 is then secured to an interior portion of interior boom 130 proximate the rear end 134 thereof. In operation, interior and exterior chains operate to extend and retract intermediate 120 and interior 130 booms as hydraulic cylinder 102 is extended and retracted.

When hydraulic cylinder 102 is extended, it forces intermediate boom 120, and thus exterior roller bearing 160 forward, thereby forcing exterior chain 140 to pull interior boom 130 forward simultaneously. In a complimentary fashion, as cylinder 102 is retracted it forces intermediate boom and thus interior roller bearing 170 backwardly, thereby forcing interior chain 150 to pull interior boom 130 rearwardly into a retracted position. In this fashion, intermediate boom 120 and interior boom 130 are able to move forward and back in concert through the operation of a single hydraulic cylinder 102.

Referring now to FIGS. 10, 12, 13, and 14 boom assembly 100 further comprises a plurality of forward and rear leveling plates, 180 and 190 respectively that are utilized to vertically space intermediate 120 and interior boom 130 from each other and from exterior boom 110, as well as provide a mechanism for leveling intermediate boom 120 and interior boom 130. This feature of the invention assures a boom assembly 100 wherein each boom stage may be maintained level with its adjacent stages so that when frame assembly 50 is level, each boom stage is also level. This arrangement results in an extremely level and consistent finished concrete surface. A pair of forward leveling plates 180 are secured to opposed sides of exterior boom 110 and intermediate boom 120. Forward plates 180 include a mounting portion 182 that is mounted to an interior surface of exterior boom 110 and intermediate boom 120 by inserting fasteners 210 through suitable apertures in booms 110, 120 and then through adjustment slots 184 in leveling plate 180. Forward leveling plates 180 also include a bearing flange 186 which includes a slot 184 and aperture 185 each accepting an axle for a roller bearing 188. Roller bearings 188 engage the upper and lower surfaces of booms 120, 130 thereby permitting them roll across the bearing surfaces as they are extended and retracted. Additionally, slotted apertures 184 permit both the height of the leveling plate 180 and that the upper roller bearing to be modified to facilitate the leveling of booms 110 and 120.

Figure 10:
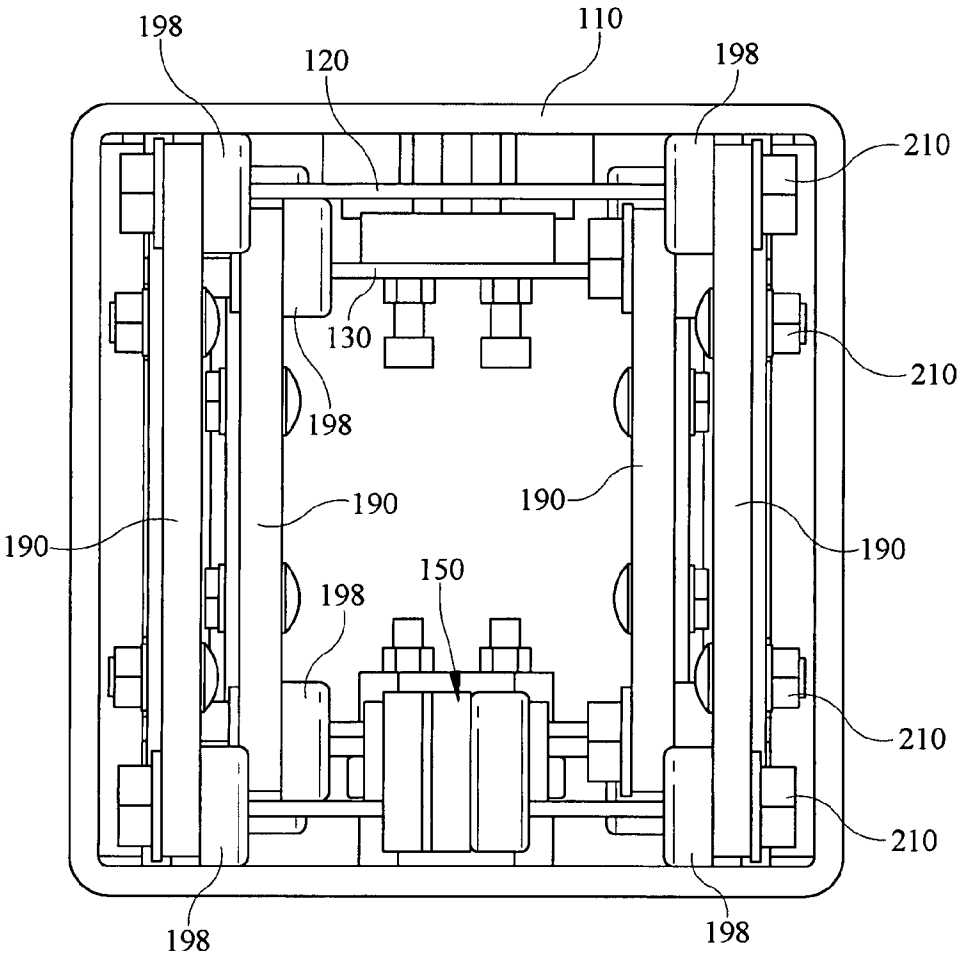
FIG. 10 is a cross-sectional view of a telescopic boom assembly taken along the line 10-10 of FIG. 4 in accordance with one embodiment of the present invention.
Figure 14:
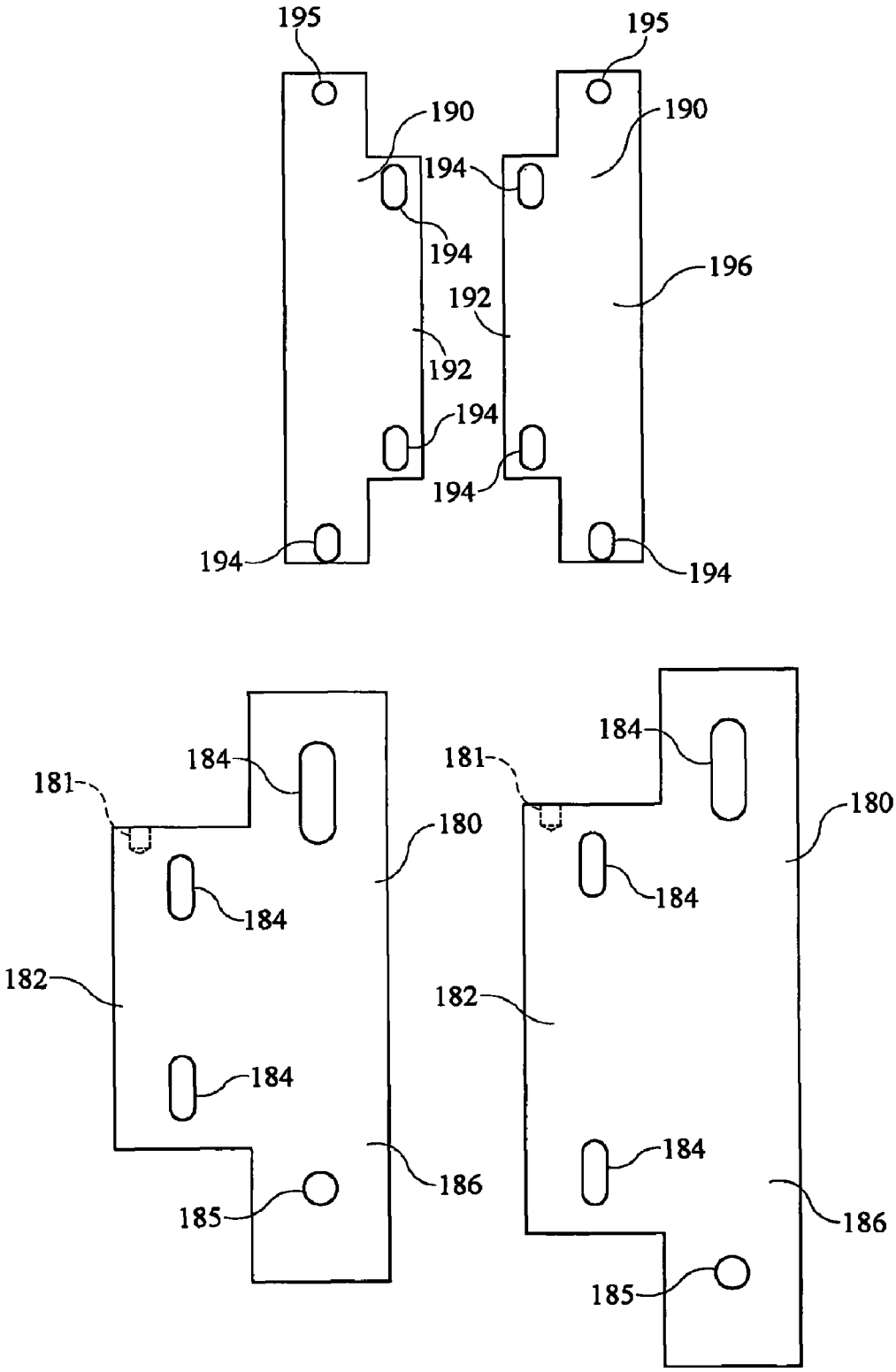
FIG. 14 is a plan view of a plurality of leveling plates in accordance with one embodiment of the present invention.

Similarly and as best seen in FIGS. 10, 12, and 14, rear leveling plates 190 also comprise a mounting portion 192 and a plurality of slotted apertures 194, one of which is disposed in a bearing flange 196 at a lower portion thereof. Bearing flange 196 also includes an upper aperture 195 for accepting a roller bearing 198 axle. FIG. 12 depicts a cross-sectional view of boom assembly 100 including rear leveling plates 190 and roller bearings 198 secured thereto by use of conventional fasteners 210. Rear leveling plates 190 are secured to the intermediate 120 and interior booms 130 at the rear end thereof. Accordingly, and as best seen in FIGS. 12 and 15, the relative motion between interior boom 130 and intermediate boom 120 is guided by roller bearings 198 secured to interior boom 130 via rear leveling plate 190. Similarly, the relative motion between exterior boom 110 and intermediate boom 120 is guided by roller bearings 198 secured to intermediate boom 120 via rear leveling plates 190. Additionally by varying the vertical position of leveling plates 190 and lower roller bearing 198 the level of the rear portion of intermediate 120 and interior boom 130 may be readily adjusted.

Figure 13:
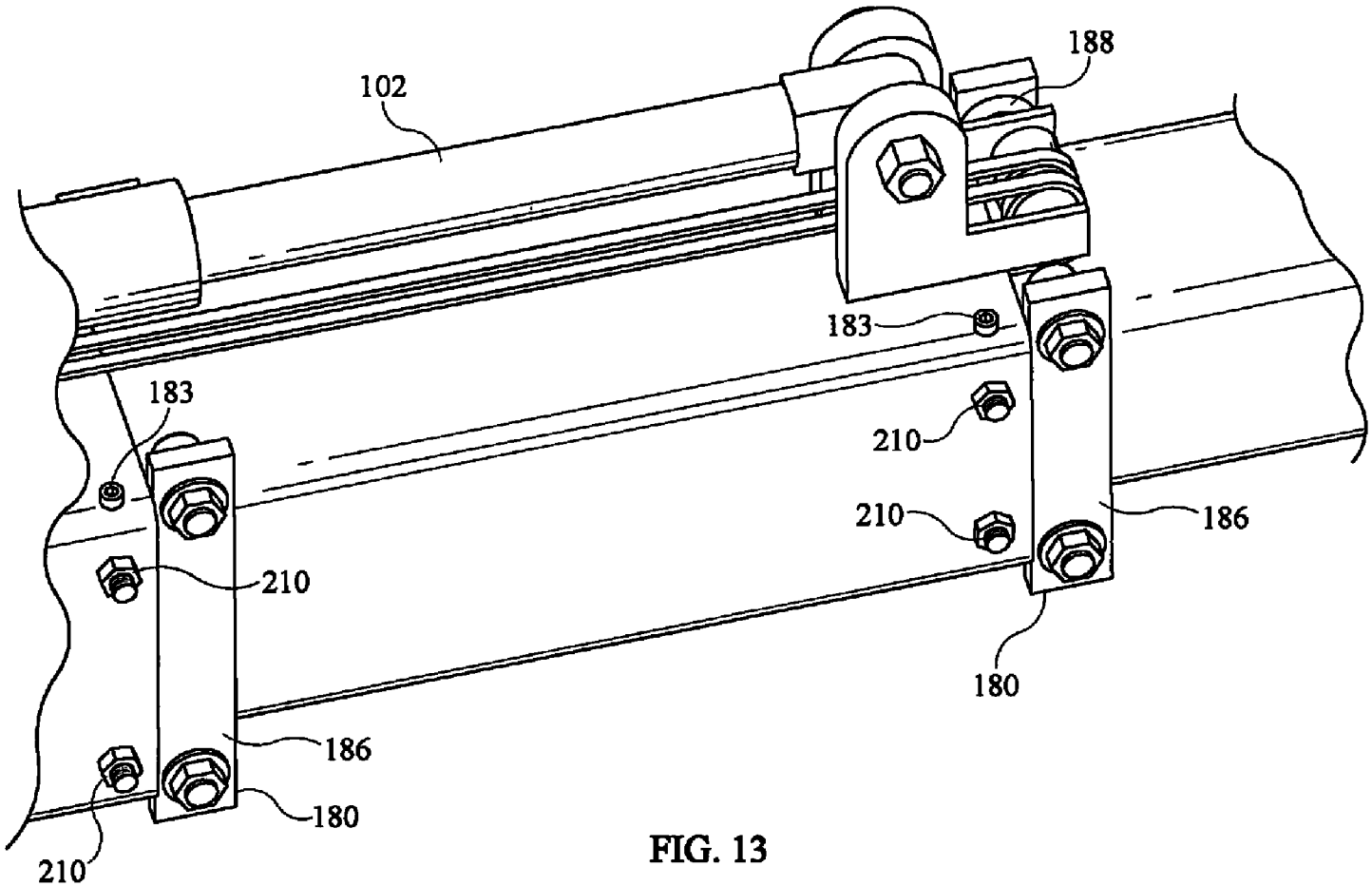
FIG. 13 is an isometric view of a telescopic boom assembly in accordance with one embodiment of the present invention.

Additionally, as best seen in FIGS. 12, 13 and 14, a leveling set screw 183 may engage threaded aperture in exterior boom 110 and a threaded aperture 181 in leveling plates 180 to enable an operator to vertically adjust leveling plates 180. In operation, fasteners 210 are loosened to enable vertical adjustment of the plates by turning set screw 193. Once leveling plates 180 are properly positioned, fasteners 210 are once again tightened. In an analogous fashion, the forward leveling plates mounted to the intermediate boom may also include a threaded aperture for accepting a leveling set screw 183.

Thus it becomes apparent that the forward 180 and rear 190 leveling plates enables the intermediate 120 and interior 130 booms to be leveled to a high degree of accuracy with respect to exterior boom 110, thereby providing an extremely level finished surface.

Figure 6:
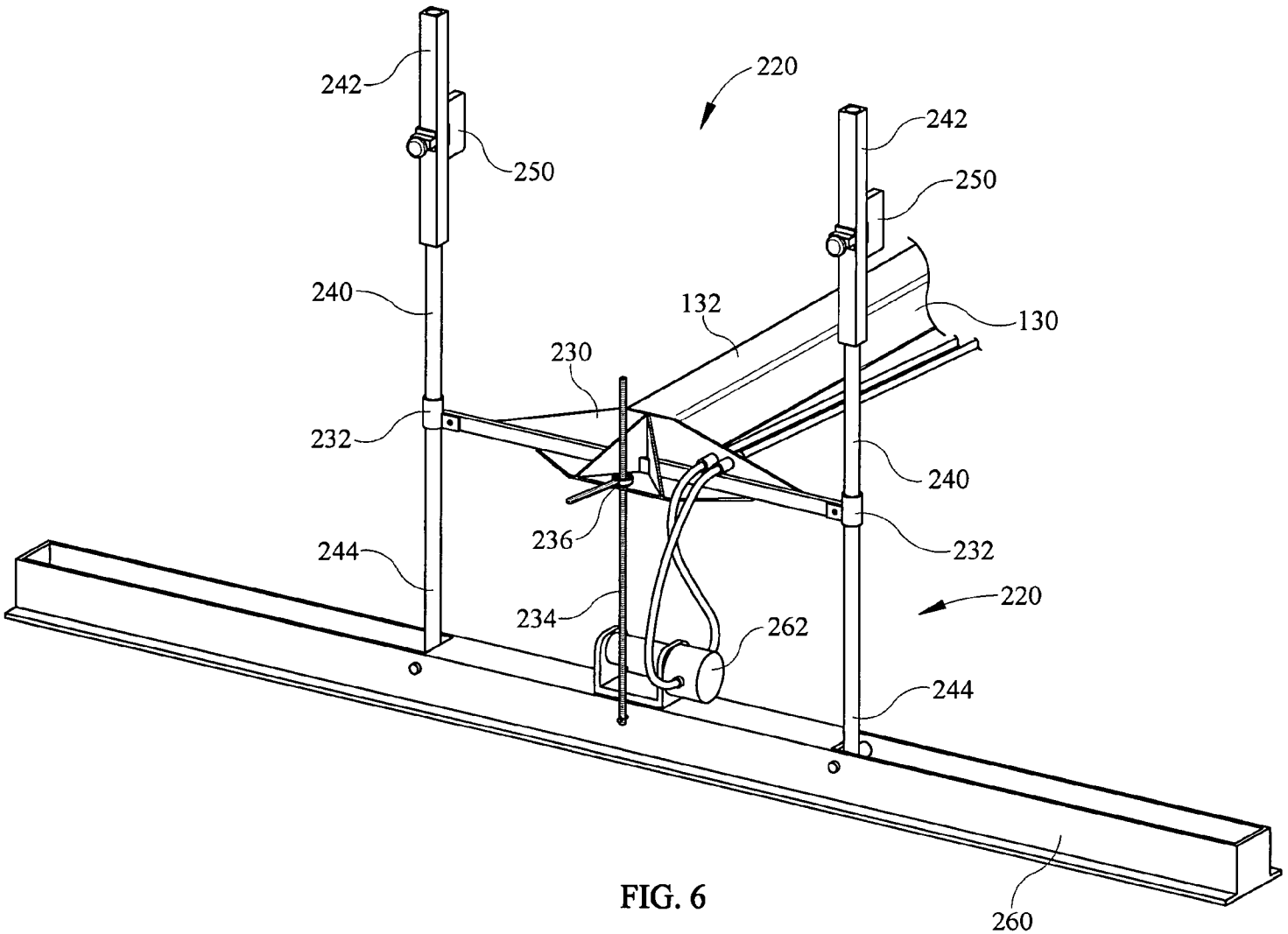
FIG. 6 is a perspective view of a screed head mounted to a boom in accordance with one embodiment of the present invention.
Figure 7:
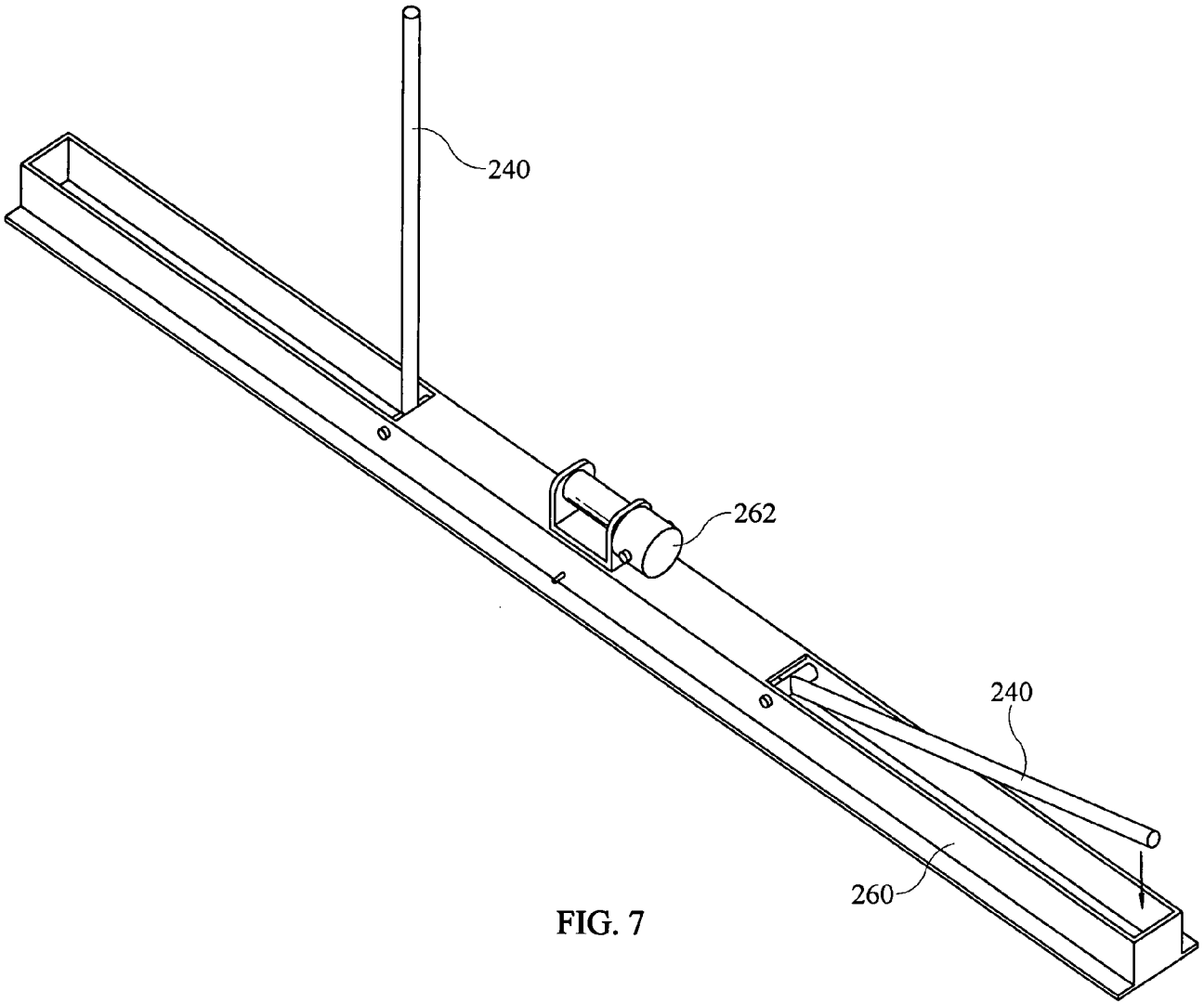
FIG. 7 is a perspective view of a screed head in accordance with one embodiment of the present invention.
Figure 8:
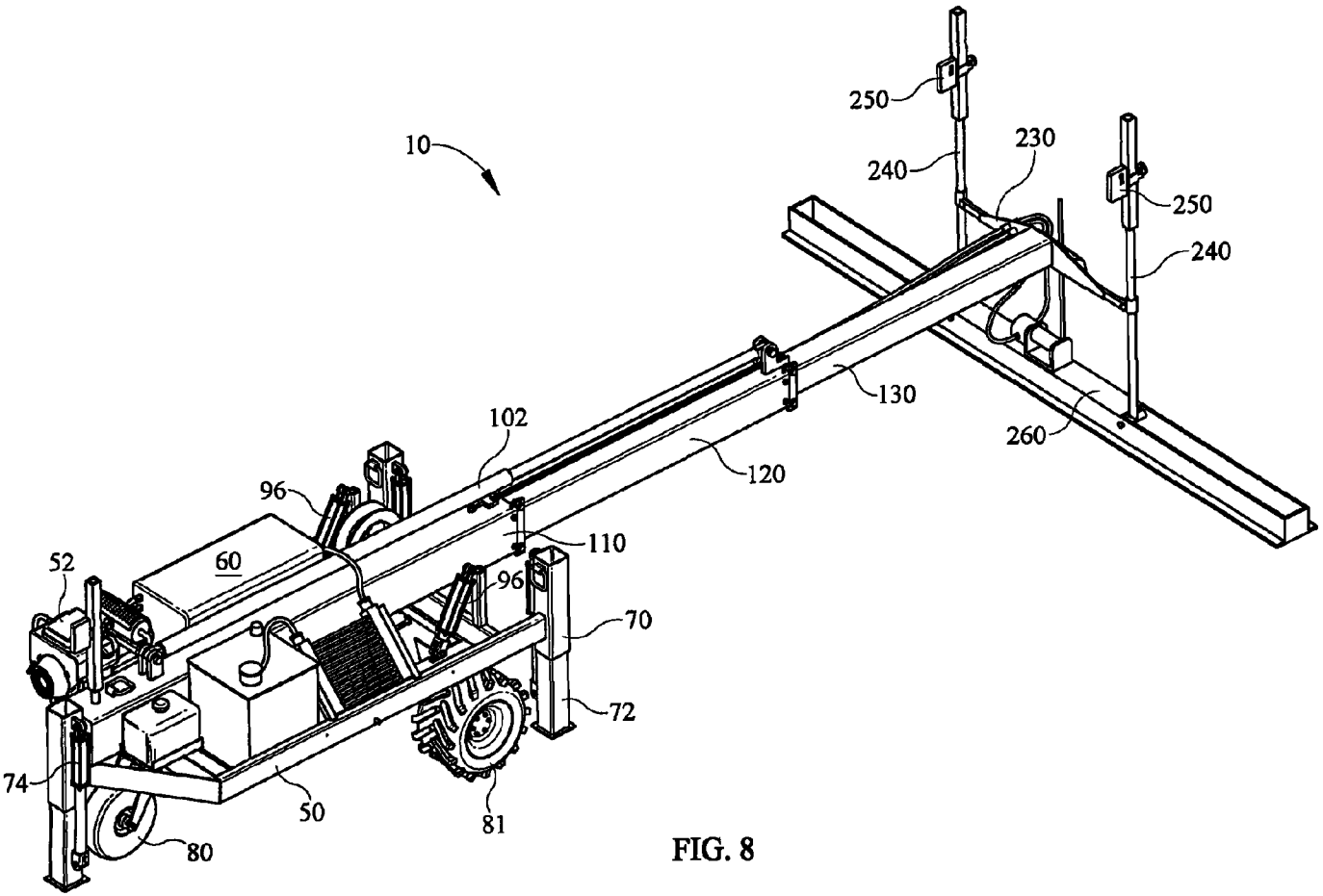
FIG. 8 is a perspective view of a concrete screeder with its boom extended in accordance with one embodiment of the present invention.

Referring now to FIGS. 1, 6 and 7 screeding apparatus 10 may further comprise a screeder head assembly 220 secured to a forward end 132 of interior boom 130. Head assembly 220 comprises a generally horizontal cross-member 230 having a pair of spaced tubes 232 through which two vertically oriented head-adjustment poles 240 are inserted. Adjustment poles 240 may be secured to spaced tubes 232 by a clamp or other conventional fastener such that their level may be readily adjusted. Adjustment poles 240 further include a rotatable upper sleeve 242, to which a laser receiver 250 may be secured, and a lower end 244 pivotably secured to a screeder head 260. Laser receivers 250 may be positioned on any side of poles 240 via rotation of sleeves 242, so that laser receivers 250 may detect a laser beam directed from a transmitter located anywhere around apparatus 10.

Screeder head 260 is a generally elongate member having flat surface along the lowermost portion thereof for smoothing and leveling concrete. One of ordinary skill will appreciate that screeder heads may be configured in varying sizes and shapes adapted for specific screeding applications. Additionally, head assembly 220 may comprise an hydraulically operated vibrator 262 which provides vibratory pulses to screeder head 260 thereby assisting in floating and settling poured concrete. As seen in FIG. 7 adjustment poles 240 may be pivotably secured to screeder head 260 to enable compact storage when head 260 is not in use. Head assembly 220 may also comprise a threaded rod 234 which is threaded through an aperture 236 in said central member and secured at a terminal end to screed head 260. Threaded rod 234 aids in quickly and accurately adjusting the vertical position of screed head 260 relative to boom assembly 100.

Figure 3:
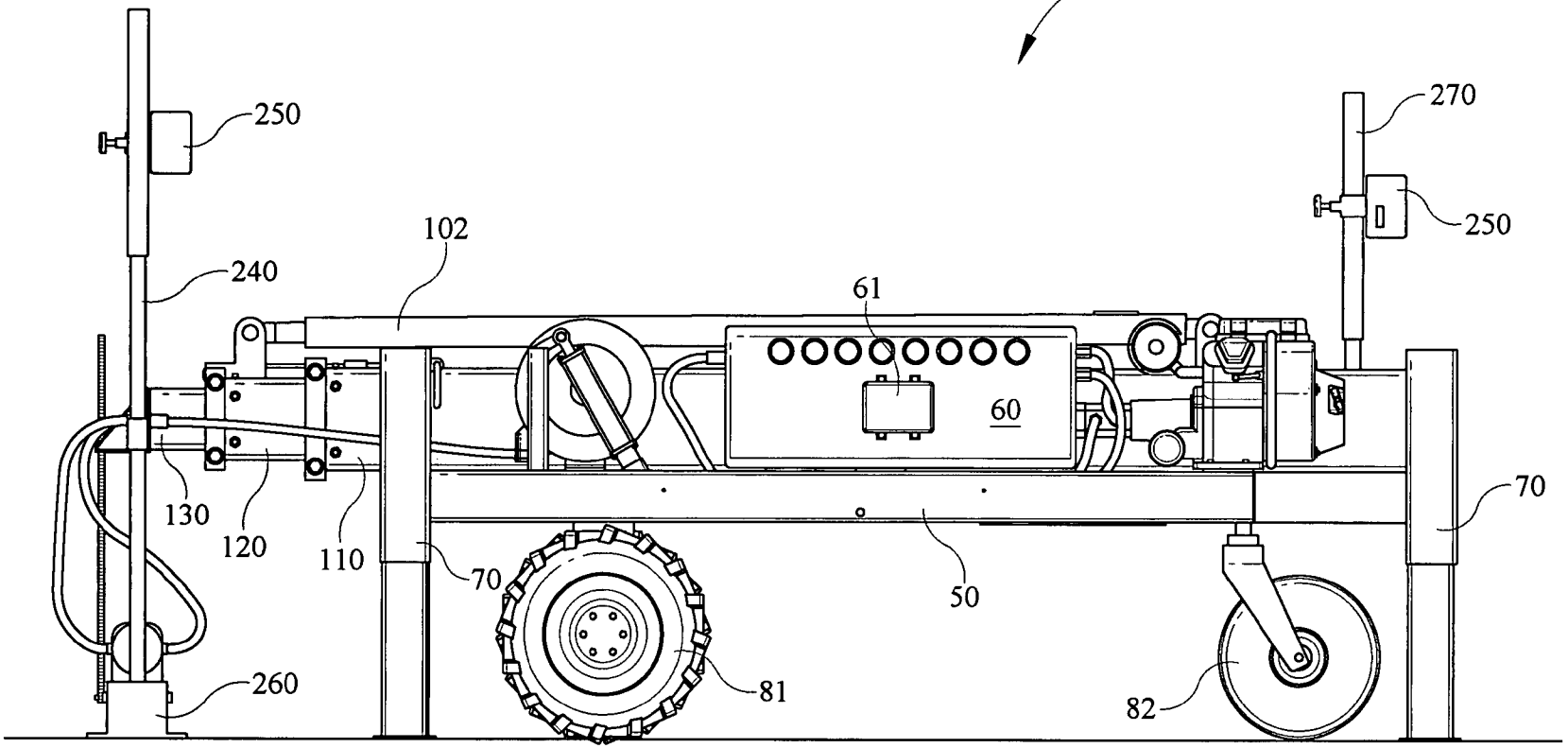
FIG. 3 is an elevation view of a concrete screeder with its boom retracted in accordance with one embodiment of the present invention.
Figure 4:
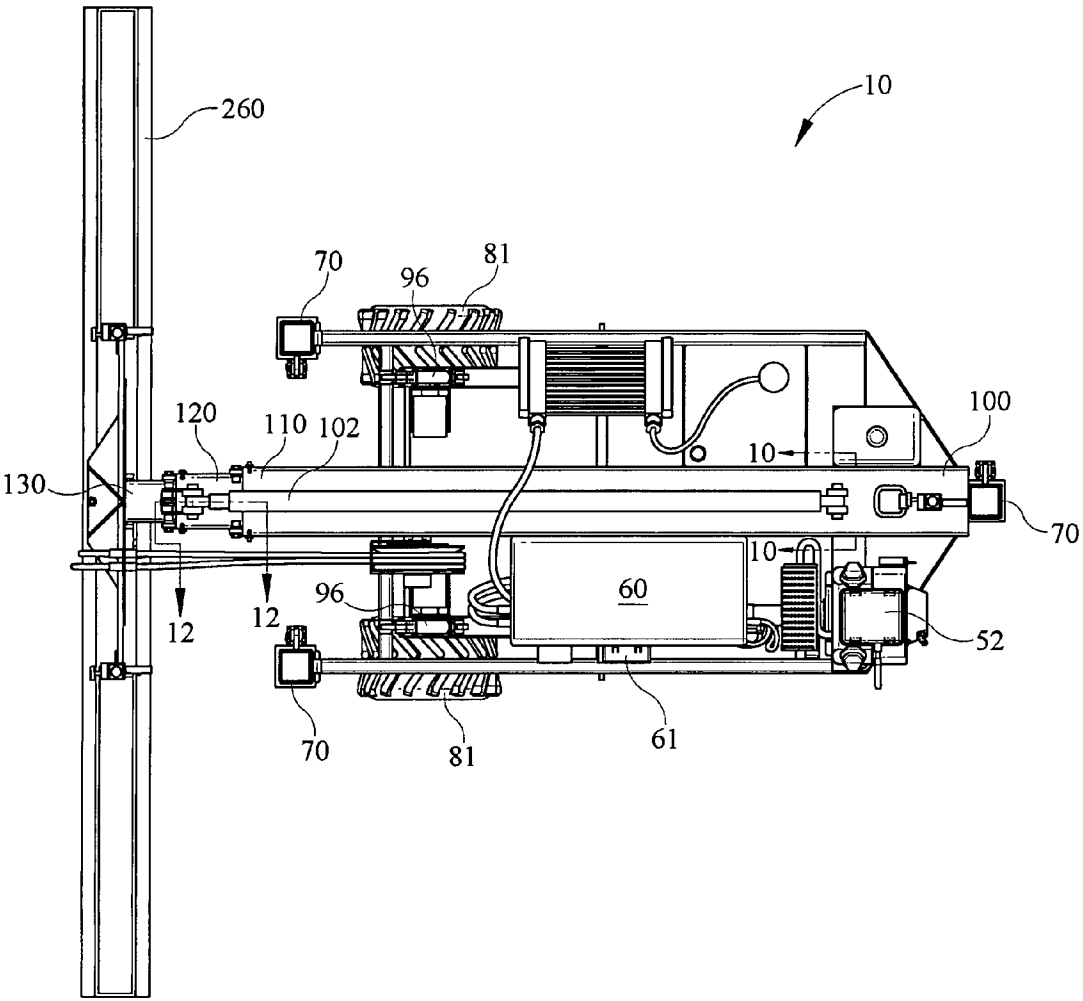
FIG. 4 is a top view of a concrete screeder in accordance with one embodiment of the present invention.
Figure 11:
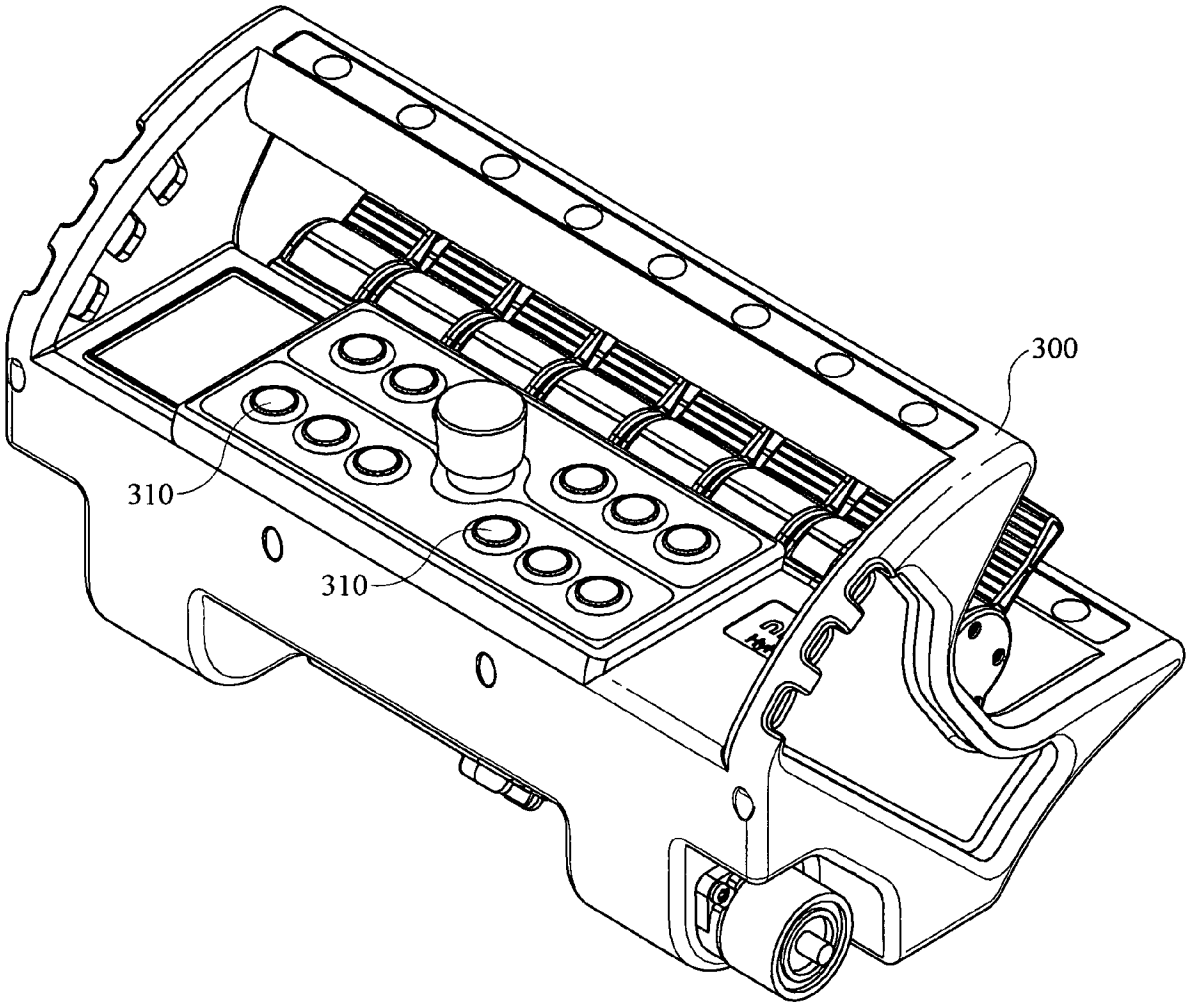
FIG. 11 is a perspective view of an operator's remote control in accordance with one embodiment of the present invention.

Referring to FIG. 3, a rotatable central upright 270 may be mounted to frame assembly 50 at a rear end thereof, and be adapted to accept a laser receiver 250 secured at a point thereto. Accordingly, the invention employs three laser receivers 250, such that in almost any orientation all three receivers will be able to receive a transmitted beam, thus enabling an operator to rapidly level apparatus 10. Additionally, FIG. 11 depicts a remote control wireless transmitter 300 having a plurality of valve actuation pushbuttons 310, which sends a plurality of wireless signals to a concomitant wireless receiver adopted to actuate the various hydraulic valves used to control screeding apparatus 10. In one embodiment of the invention, a wiring harness may be supplied that may be connected between wireless transmitter 300 and the wireless transceiver 61, thereby providing a hard-wired control capability in the event of failure of the wireless transceiver, wireless transmitter, or alternatively, for operation in high electrical noise environments wherein wireless operation may prove unreliable or where wireless use is prohibited.

In operation, the screeding apparatus 10 provides a simple and extremely accurate device for finishing a poured concrete surface. A laser transmitter (not shown) is provided to transmit a level laser beam at a predetermined level or grade from the ground. The screeding process is initiated by leveling apparatus 10 frame assembly 50, and thus the boom assembly 100 at any location proximate the desired pour area utilizing the stabilization legs 70. The frame assembly may be leveled by simply using a bubble level or similar device, either secured to frame assembly 50 as an integral component thereof or using a more precise traditional hand-held level.

The screed head 260 is then set to a desired height and grade as required for the finished floor, whereupon the laser receivers 250 are then adjusted upwardly or downwardly until they receive the beam being transmitted. At this point, the apparatus is ready to screed poured concrete, which is accomplished by extension and retraction of booms 120 and 130 via actuation of cylinder 102. If the booms must be raised to negotiate an obstacle, hydraulic cylinders 96 may be used to raise frame assembly 50 thereby forcing front wheels 81 down and lifting frame assembly 50 up. Once the obstacle is negotiated, the apparatus can rapidly be re-leveled utilizing hydraulic cylinders 74 of stabilization legs 70 until laser receivers 250 once again detect the transmitted light beam.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. An apparatus for screeding concrete to produce a level finished surface comprising:

a rigid frame assembly;

a telescopic boom assembly secured directly to said frame assembly whereby said boom assembly is leveled by leveling said frame assembly; said telescopic boom having an exterior boom secured directly to said frame assembly, an intermediate boom disposed inside said external boom, and an interior boom disposed inside said intermediate boom, wherein said intermediate boom is movable relative to said exterior boom, and wherein said interior boom is movable relative to both said exterior and said intermediate booms;

a pair of leveling plates secured to opposed sides of said exterior boom at a forward end thereof, said leveling plate comprising a pair of opposed upper and lower horizontal roller bearings for engaging a top and bottom exterior surface of said intermediate boom respectively, said upper roller bearing being vertically adjustable thereby permitting leveling of said intermediate boom with respect to said exterior boom, said leveling plates having a plurality of slots therein for engagement with a fastener secured to said exterior boom, whereby said leveling plates may be vertically adjusted; and a set screw extending through an exterior surface of said exterior boom and threadably engaged with an aperture in a leveling plate, whereby rotation of said set screw vertically adjusts said leveling plate; and a screeder head assembly having a plurality of vertically oriented alignment poles secured to said telescopic boom assembly and a screeder head secured to said alignment poles.

2. An apparatus for screeding concrete to produce a level finished surface as claimed in claim 1 comprising:

a plurality of adjustable stabilization legs secured to said frame assembly to level said frame assembly with respect to a reference plane.

3. An apparatus for screeding concrete to produce a level finished surface as claimed in claim 1 comprising:

at least one wheel having a cantilever mount assembly secured to a forward end of said frame assembly for elevating the forward end thereof, thereby elevating said screeder head to avoid obstacles on said surface.

4. An apparatus for screeding concrete to produce a level finished surface as claimed in claim 1 comprising:

said telescopic boom having two or more boom sections that are movable relative to each other.

5. An apparatus for screeding concrete to produce a level finished surface as claimed in claim 4 comprising:

a pair of leveling plates secured to opposed sides of said intermediate boom at a rear end thereof, said leveling plate comprising a pair of opposed upper and lower horizontal roller bearings for engaging a top and bottom interior surface of said exterior boom respectively, said lower roller bearing being vertically adjustable thereby causing leveling of said intermediate boom with respect to said exterior boom.

6. An apparatus for screeding concrete to produce a level finished surface as claimed in claim 1 comprising:

a pair of leveling plates secured to opposed sides of said intermediate boom at a forward end thereof, said leveling plate comprising a pair of opposed upper and lower horizontal roller bearings for engaging a top and bottom exterior surface of said interior boom respectively, said upper roller bearing being vertically adjustable thereby permitting leveling of said interior boom with respect to said intermediate boom.

7. An apparatus for screeding concrete to produce a level finished surface as claimed in claim 5 comprising:

a pair of leveling plates secured to opposed sides of said interior boom at a rear end thereof, said leveling plate comprising a pair of opposed upper and lower horizontal roller bearings for engaging a top and bottom interior surface of said intermediate boom respectively, said lower roller bearing being vertically adjustable thereby permitting leveling of said interior boom with respect to said intermediate boom.

8. An apparatus for screeding concrete to produce a finished surface as claimed in claim 6 comprising:

a pair of leveling plates secured to opposed sides of said intermediate boom at a forward end thereof, said leveling plates having a plurality of slots therein for engagement with a fastener secured to said exterior boom, whereby said leveling plates may be vertically adjusted.

9. An apparatus for screeding concrete to produce a finished surface as claimed in claim 8 comprising:

a set screw extending through an exterior surface of said intermediate boom and threadably engaged with an aperture in a leveling plate, whereby rotation of said set screw vertically adjusts said leveling plate.

10. An apparatus for screeding concrete to produce a finished surface as claimed in claim 1 comprising:

a plurality of laser receivers positioned at a plurality of points for receiving a laser leveling beam.

11. An apparatus for screeding concrete to produce a finished surface as claimed in claim 10 wherein said pair of laser receivers are rotatably secured to said screed head poles.

* * * * *